US006765134B2

(12) United States Patent
Bartz

(10) Patent No.: US 6,765,134 B2
(45) Date of Patent: Jul. 20, 2004

(54) STRING STATION ASSEMBLY

(76) Inventor: James Bartz, 5777 Milwaukee River Pkwy., Glendale, WI (US) 53209

( * ) Notice: Subject to any disclaimer, the term of this patent is extended or adjusted under 35 U.S.C. 154(b) by 244 days.

(21) Appl. No.: 10/021,512

(22) Filed: Dec. 7, 2001

(65) Prior Publication Data

US 2002/0069747 A1 Jun. 13, 2002

Related U.S. Application Data

(60) Provisional application No. 60/254,524, filed on Dec. 8, 2001.

(51) Int. Cl.[7] ..... G10D 3/00
(52) U.S. Cl. ..... 84/291; 84/645
(58) Field of Search ..... 84/290, 291, 314 R, 84/327–329

(56) References Cited

U.S. PATENT DOCUMENTS 4,142,436 A * 3/1979 Chapman ..... 84/723
4,240,319 A * 12/1980 Soupios ..... 84/263
4,530,268 A * 7/1985 Starrett ..... 84/727
5,442,986 A * 8/1995 Cota ..... 84/267
5,883,320 A * 3/1999 Lashley ..... 84/312 P
6,043,422 A * 3/2000 Chapman ..... 84/723
6,127,615 A * 10/2000 Rosenberg ..... 84/465

* cited by examiner

*Primary Examiner*—Jeffrey W. Donels
(74) *Attorney, Agent, or Firm*—Joseph S. Heino; Patrick M. Bergin

(57) ABSTRACT

An instrument or assembly utilizes a foundation, or platform, which foundation or platform houses a combination of separate and different string elements. The first string element uses the concept familiar to the Chapman Stick, a ten-string fret board. The foundation also includes other string elements, including a plurality of altered eight-string slide guitars and at least one modified six-string guitar all of which are similarly mounted to the foundation or platform. Various controllers are used to output the string vibrations of these various stringed elements to a programmable digital surround mixer which allows for sound processing, enhancement and blending of the sounds generated by the different string arrays used within the instrument.

20 Claims, 2 Drawing Sheets

STRING STATION ASSEMBLY

This Application claims the benefit of U.S. Provisional Application No. 60/254,524, filed Dec. 8, 2001.

FIELD OF THE INVENTION

This invention relates generally to musical instruments. More particularly, it relates to a stringed musical instrument, or assembly, having a plurality of stringed slide guitar elements each of which has electronic pick-up and output to a programmable digital mixer to create unique futuristic sounds.

BACKGROUND OF THE INVENTION

As is well known in the art, the modern day electric guitar produces sounds by electronic amplification of string vibrations. This instrument amounts to a steel-strung acoustic guitar with an electromagnetic pick-up which is, in turn, connected to an electronic amplification system. An electric cord connects the guitar to an amplifier and a speaker. Controls on the guitar regulate the sound which is produced by the string vibrations. The strings are fastened or anchored to a bridge which is situated atop the guitar face. The strings extend along a fingerboard and are tied to rotatable tuning keys located at the head of the guitar. Narrow metal strips, called frets, lie on the fingerboard and are situated generally perpendicularly below the strings. Each such fret marks the position of a specific tone. The musician presses the strings behind the frets with the fingers of one hand while strumming or plucking the strings with the other hand. The string vibrates and those vibrations are electromagnetically registered on the pick up.

SUMMARY OF THE INVENTION

Now, imagine a musician playing on what might look at first glance to be a keyboard, except that the keyboard has forty or so strings situated on it instead of keys. Also imagine that the sounds being generated by the strings of such a novel instrument are electronically processed and enhanced. The virtually limitless array of vibrations and sounds generated by this single instrument are not imagination, but rather the subject of this invention.

The present invention sprang to life by borrowing from the concept familiar to a ten-stringed instrument called the "Chapman Stick." The Chapman Stick is a long and cumbersome instrument which runs the upper length of a musician's body. Because of its long size, the musician desirous of playing the Chapman Stick must continually stand in order to play it. This inventor, while experimenting with new sounds, took one such Chapman Stick and laid it out across his lap, very much as one would as if he were playing a keyboard. At the same time, this inventor had an eight-string slide guitar set up. After playing an open low bass note on the Chapman Stick, this inventor accidentally bump-strummed the slide guitar while reaching over to move a fader, or sliding control knob. The resulting sound which emanated was like no other sound this inventor has ever heard before it. It was unique and provided the impetus to explore the textures available by playing these two instruments at the same time. By expanding this combination to include the tonal qualities of other string elements added to this most basic combination, this inventor found that truly new and unique sounds could be generated by a single instrument having composite string elements.

Accordingly, it is an object of the present invention to create a novel string instrument or assembly which allows a number of different string arrays to be played by one musician at one time for generating unique sounds. It is another object to create such an array which can be mounted onto a single foundation for ease of use by the musician. It is yet another object to provide means for electrical pick-up of the string vibrations generated by the instrument such that the vibrations can be outputted to a programmable digital surround mixer for further sound processing and enhancement. It is yet another object of the present invention to electronically blend the sounds generated by the different string arrays used within the instrument. It is still another object of the present invention to make one or more of the stringed elements of the device removably attachable and detachable from the foundation.

The present invention has obtained these objects. It comprises an instrument or assembly which utilizes a foundation, or platform, which foundation or platform houses a combination of separate and different string elements. The first string element uses the concept familiar to the aforementioned Chapman Stick, a ten-string fret board. The foundation also includes other string elements, including a plurality of altered eight-string slide guitars and at least one modified six-string guitar all of which are similarly mounted to the foundation or platform. Various controllers are used to output the string vibrations of these various stringed elements to a programmable digital surround mixer which allows for sound processing, enhancement and blending of the sounds generated by the different string arrays used within the instrument. The foregoing and other features of the present invention will become apparent from the detailed description which follows.

DETAILED DESCRIPTION

Figure 1:
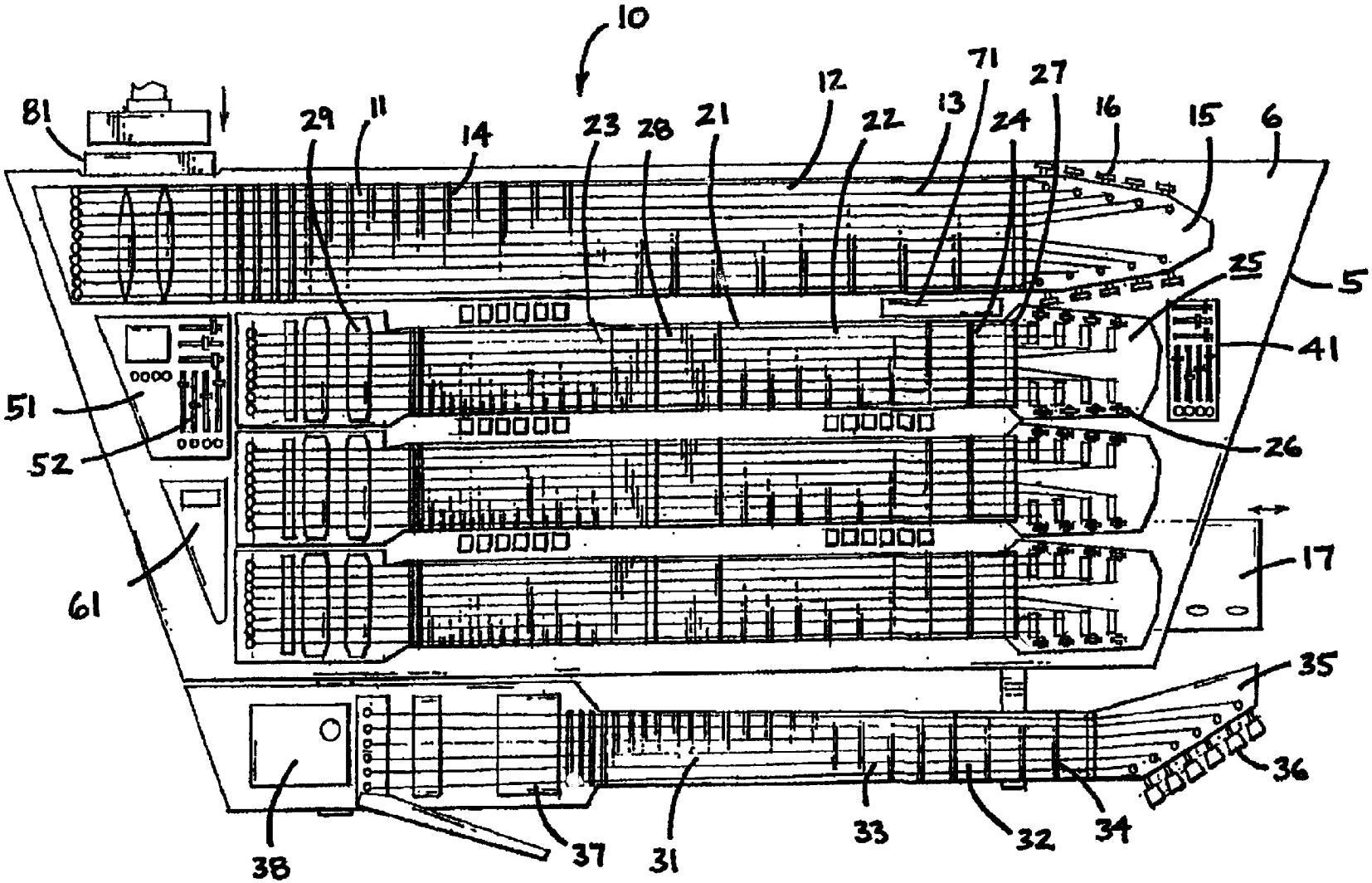
FIG. 1 is a top plan view of an embodiment of an apparatus constructed in accordance with the present invention.

Referring now to the drawings in detail, wherein like numerals represent like elements throughout, FIG. 1 shows an embodiment of a string station instrument or assembly, generally identified 10, which has been constructed in accordance with the present invention. The string station assembly 10 has as its foundation a base 5. The base 5 includes an upwardly facing top surface 6 atop which there are situated a number of string arrays as will be further described. The base 5 also includes a downwardly facing bottom surface (not shown) which is functionally adapted to rest upon another surface, such as the lap of a musician. See FIG. 2. The upwardly facing top surface 6 of the base 5 includes a first string element 11 which is, in the preferred embodiment, a ten-string fret board based upon the aforementioned Chapman Stick idea. This ten-string fret board 11 is utilized to provide the base frequency element of the assembly 10. This ten-string fret board 11 can be built into the base upper surface 6 as an integral section of the base 5 or it can be made to be seated by use of a specifically modified Chapman Stick which would then be placed into a custom slot (not shown) on the upper face 6 of the string station base 5. This first string element 11 includes a longitudinally extending fingerboard 12, ten strings 13 and a plurality of frets 14. The strings 13 run generally parallel to the fingerboard 12. The frets 14 are anchored generally perpendicular to the fingerboard 12. The strings 13 are tied to rotatable tuning keys 16 located at the head 15 of that string element 11.

The base 5 of the string station assembly 10 also includes a plurality of second string elements 21, which in the preferred embodiment are eight-string slide guitars. In this embodiment, three such guitars 21 are constructed into the base 5 and are provided as the main chordal and rhythm elements of the assembly 10. As was true of the first string element 11, each of the second string elements 21 includes a longitudinally extending fingerboard 22, eight strings 23 and a plurality of frets 24. The strings 23 run generally parallel to the fingerboard 22 and the frets 24 are anchored generally perpendicular to the fingerboard 12. The strings 23 are tied to rotatable tuning keys 26 located at the head 25 of each second string element 21. Included as part of each of the eight-string slide guitars 21 are custom detented sliding bridges 28 which slide beneath the plurality of strings 23 to alter keys and pitches. Built in touch sensitive electronic bowing devices 29 are included under the strings 23 to provide endless touch-on/touch-off sustain of notes and chords. Custom pickups 27 with an adjustable auto fade time on the volume captures the sympathetic vibration of the strings 23 on the opposite side of the bridges 28 and is used in both stereo and more applicable surround-sound applications.

The string station assembly 10 of the present invention also includes a third string element 31, which in the preferred embodiment is a six-string guitar. As was true of the first string element 11 and the second string elements 21, the third string element 31 includes a longitudinally extending fingerboard 32, six strings 33 and a plurality of frets 34. The strings 33 run generally parallel to the fingerboard 32 and the frets 34 are anchored generally perpendicular to the fingerboard 32. The strings 33 are tied to rotatable tuning keys 36 located at the head 35 of the third string element 31. This six-string guitar 31 is similarly fitted with a custom electronic bowing assembly 37 which is press activated. This six-string guitar 33 may be lifted from the assembly 10 by the musician to be played in a conventional guitar manner as well. A standard guitar control 38 is provided along with custom control of the guitar processors and musical instrument digital interface (hereinafter "midi").

The string station assembly base 5 also includes a slide-out holster 17 for holding percussion implements (not shown). The assembly 10 can serve as a very percussive one when the strings 13, 23, 33 are struck with playing sticks in a drumming type motion. The effect of this, to this inventor, is very much like that of an electric dulcimer.

A number of controls are provided as integral to the string station assembly base 5. In the embodiment described, a main output mixer 51 with parameter faders 52 is provided. The faders 52 are provided instead of conventional control knobs. The base 5 also includes a midi trigger control panel 61. The series of midi trigger strips (not shown) in the panel 61 control an internal and external basic midi. This is akin to building a Roland PAD80 into the assembly 10 which will allow the triggering and playing of any outboard midi sound device. An internal tuner display 71 is also provided. All guitar outputs are "hardwired" to a full read left to right illuminated tuning meter which is custom internal mounted into the instrument face 6 for ease of view while performing. A series of up-down buttons and faders for strong fader arrays of specific outboard digital, signal processing, or DHSP parameters via midi is provided by virtue of the midi parameter controller 41 provided on the base 5. This allows a two-way control of digital parameters and anything which is otherwise controllable via sysex on a midi device. An output panel 81 is provided.

Figure 2:
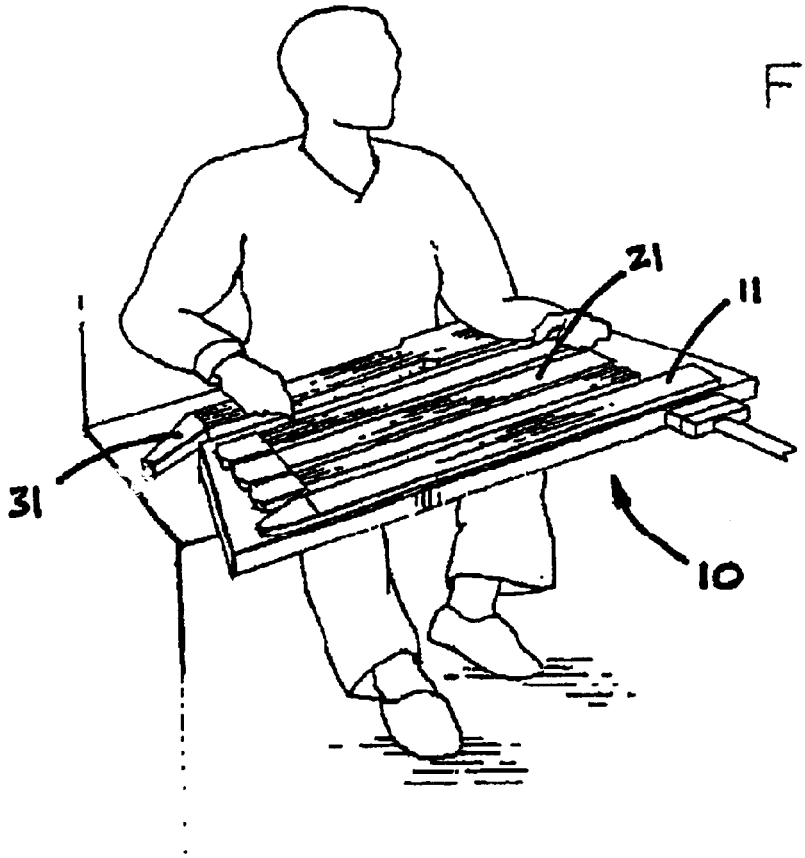
FIG. 2 is a perspective view of the apparatus shown in FIG. 1 as it is intended to be held by a musician.
Figure 3:
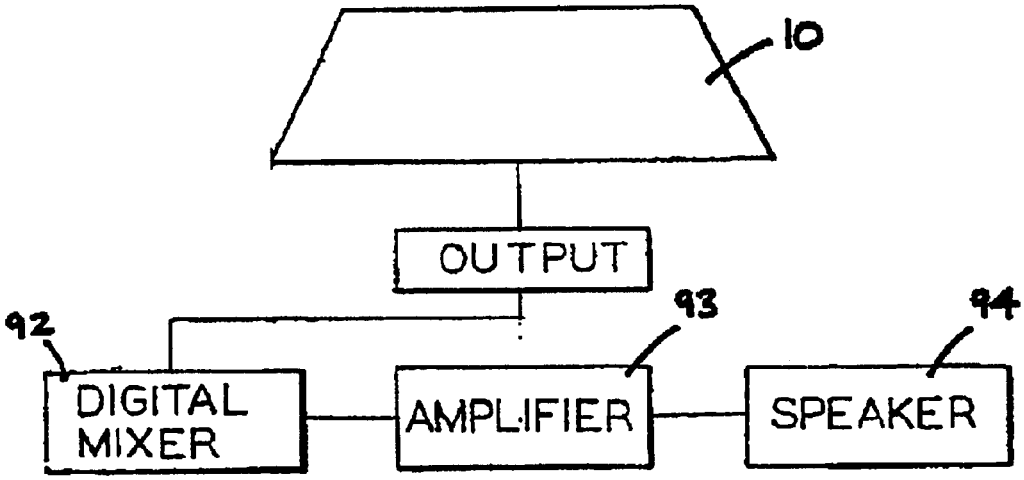
FIG. 3 is a schematic block diagram showing use of the apparatus with other sound enhancing elements.

FIG. 2 illustrates the fashion in which the string station assembly 10 may be held by a musician in the seated position. Though illustrated as an instrument for a left-handed player, it is to be understood that the string station assembly 10 can be mirrored for a right handed player as well. As shown in FIG. 3, the string station assembly 10 is electrically outputted to a digital mixer 92. The mixer 92 is connected to an amplifier 93 and a speaker 94 from which the end product is emitted.

From the foregoing detailed description of the illustrative embodiment of the present invention, it will be apparent that there has been provided a new and useful string instrument or assembly which allows a number of different string arrays to be played by one musician at one time for generating unique sounds; which string p-rays can be mounted onto a single foundation for ease of use by the musician; which provides means for electrical pick-up of the string vibrations generated by the instrument such that the vibrations can be outputted to a programmable digital surround mixer for further sound processing and enhancement; which electronically blends the sounds generated by the different string arrays used within the instrument; and which allows one or more of the stringed arrays of the device removably attachable and detachable from the foundation.

What is claimed is:

1. A musical instrument comprising a generally planar base, a ten-string fret board mounted on the base, a plurality of eight-string slide guitars mounted generally parallel to the fret board on the base, and a six-string guitar mounted generally parallel to the fret board on the base.

2. The musical instrument of claim 1 wherein the base includes a main output mixer for combining multiple audio signals with parameter faders for adjusting the volumes of the audio signals.

3. The musical instrument of claim 2 wherein the base includes a midi and a control panel for the midi to control the audio signals combined by the mixer.

4. The musical instrument of claim 3 wherein the musical instrument can trigger and play any outboard midi sound device.

5. The musical instrument of claim 4 wherein the musical instrument includes an illuminated tuning meter mounted internally in the base.

6. The musical instrument of claim 5 wherein the musical instrument includes a series of up-down buttons and faders to produce strong fader arrays of specific outboard digital signal processing.

7. The musical instrument of claim 6 wherein the musical instrument includes an output panel for connecting with mixers and amplifiers.

8. The musical instrument of claim 7 wherein the vibrations of the strings of the musical instrument are electromagnetically converted to electrical signals and outputted to a programmable digital mixer for sound processing and secondary pick-ups are provided for use in stereo and surround-sound applications.

9. The musical instrument of claim 8 wherein the electrical signal from the digital mixer is amplified and transformed by a speaker to music.

10. The musical instrument of claim 9 wherein each of the guitars includes an electromagnetic bowing device.

11. The musical instrument of claim 10 wherein the six-string guitar is removable and playable independent of the other stringed instruments.

12. The musical instrument of claim 11 wherein the base includes a slide-out holster for holding percussive implements.

13. The musical instrument of claim 12 wherein each eight-string slide guitar has a custom detented sliding bridge to alter the pitch of the strings.

14. A musical instrument comprising an assembly base, a ten-string element mounted on the assembly base, said ten-string element including a longitudinally extending fingerboard, a plurality of eight-string slide guitars mounted generally parallel to the ten-string element on the assembly base, each slide guitar including a longitudinally extending fingerboard, a six-string guitar removably mounted generally parallel to the ten-string and eight-string elements on the assembly base, said guitar including a longitudinally extending fingerboard, an output panel for connecting the musical instrument to mixers, amplifiers and speakers, a midi parameter controller, an internal tuner display, a main output mixer with parameter faders, and a custom detented bridge for each eight-string guitar.

15. The musical instrument of claim 14 wherein the musical instrument can trigger and play any outboard midi sound device.

16. The musical instrument of claim 15 wherein the musical instrument includes a series of up-down buttons and faders to produce strong fader arrays of specific outboard digital signal processing.

17. The musical instrument of claim 16 wherein the vibrations of the strings of the musical instrument are electromagnetically converted to electrical signals and outputted to a programmable digital mixer for sound processing.

18. The musical instrument of claim 17 wherein the electrical signal from the digital mixer is amplified and transformed by a speaker to music.

19. The musical instrument of claim 18 wherein each of the guitars includes an electromagnetic bowing device.

20. The musical instrument of claim 19 wherein the base includes a slide-out holster for holding percussive implements.

* * * * *